US005669105A

United States Patent [19]

Depke

[11] Patent Number: 5,669,105

[45] Date of Patent: Sep. 23, 1997

[54] ADJUSTABLE DOOR HINGE

[76] Inventor: Hartmut Depke, Schmiedestr. 13, D-30900 Wedemark/Elze, Germany

[21] Appl. No.: 710,290

[22] Filed: Sep. 16, 1996

[51] Int. Cl.[6] ..... E05D 7/04

[52] U.S. Cl. ..... 16/245; 16/244

[58] Field of Search ..... 16/238, 244, 245, 16/240, 443, 386, 243

[56] References Cited

U.S. PATENT DOCUMENTS

| | | | |
|---|---|---|---|
| 241,280 | 5/1881 | Bausch et al. | 16/245 |

FOREIGN PATENT DOCUMENTS

| | | | |
|---|---|---|---|
| 0007255 | 1/1905 | Denmark | 16/244 |
| 0 249 945 A2 | 12/1987 | European Pat. Off. . | |
| 0 300 292 A1 | 1/1989 | European Pat. Off. . | |
| 0 403 928 A1 | 12/1990 | European Pat. Off. . | |
| 432444 | 12/1911 | France | 16/244 |
| 72.11072 | 12/1973 | France . | |
| 812 652 | 9/1951 | Germany . | |
| 28 48 247 | 5/1979 | Germany . | |
| 32 23 341 A1 | 1/1985 | Germany . | |
| 35 15 416 A1 | 11/1985 | Germany . | |
| 89 06 780 | 8/1989 | Germany . | |
| 195 16 159 A1 | 11/1995 | Germany . | |

*Primary Examiner*—M. Rachuba
*Assistant Examiner*—Mark Williams
*Attorney, Agent, or Firm*—Herbert L. Lerner; Laurence A. Greenberg; Werner H. Stemer

[57] ABSTRACT

Door hinge for adjustably mounting a door in a corresponding door frame includes a first support element having a first attachment device for fixedly connecting the first support element to the door frame, and a second support element having a substantially bolt-shaped second attachment device rotatably received in a radially extending through-hole formed in the second support element, the second attachment device having a threaded portion threadedly receivable in a respective internally threaded hole formed in the door, and being formed with an engagement device engageable by a tool for rotating the second attachment device, the second support element being formed with an internally threaded axial hole wherein a securing element for securing the second attachment device is rotatably disposed, a bolt element extending into an axially extending through-hole formed in the first support element and into an axially extending hole formed in the second support element for rotatably connecting the first and the second support elements.

15 Claims, 2 Drawing Sheets

ADJUSTABLE DOOR HINGE

FIELD OF THE INVENTION

The invention relates to a door hinge which is axially and radially adjustable.

BACKGROUND OF THE INVENTION

Door hinges are mounted at nearly every door of a building and are used for rotatably suspending and supporting a door in its corresponding door frame.

The suspension of a door is usually performed by means of two generally identical door hinges which are mounted at the upper and the lower end portion of a door and its corresponding door frame. Each door hinge is formed of a first lower support element arranged at the door frame, a second upper support element arranged at the door and a bolt-element connecting the two support elements. The bolt-element is inserted, e.g. pressed, into the lower support element of the door frame from below and projects upwardly from the lower support element. The lower support element further includes two dowels or pins which are usually arranged in one plane and which project sidewardly from the lower support element. The dowels are received in two respective holes formed in the door frame, in order to fixedly mount the support element at the door frame.

The upper support element mounted at the door is formed with blind bore which receives the other end portion of the bolt-element projecting from the lower support element thereby providing a radial bearing for rotatably axially supporting the upper support element. The axial bearing for rotatably supporting the upper support element, which is required to provide for the weight of the door, is usually formed by the opposing end surfaces of the upper and the lower support elements which rotatably slide upon one another when the door is mounted in the door frame. In the upper support element, a threaded dowel or pin is provided extending outwardly in a radial or lateral direction. The threaded dowel is screwed into an internally threaded hole formed in the door when the door is assembled. Thus, the distance between the door and the upper support element and thereby the horizontal or lateral distance between the door and the door frame can be adjusted by screwing the upper support element into or out of the door.

A disadvantage of the aforedescribed conventional door hinges is that, for each lateral adjustment, the door has to be completely removed from the door frame, in order to rotate the threaded dowel of the upper support element in its respective threaded hole formed in the door. Another disadvantage of the conventional door hinges is that they are not adjustable in an axial direction in order to alter the vertical position of a door in the respective door frame.

The published European Patent Document EP 0 300 292 A1 describes a laterally and axially adjustable door hinge which includes an upper support element formed with a radially extending hole in which a bolt-shaped attachment element, which is formed with a threaded portion and is rotatable by a hexagon socket, is rotatably supported. A stud screw is rotatably arranged in an internally threaded axial hole formed in the upper support element. The end portion of the stud screw extends into a groove formed in the attachment element, so that the attachment element is fixed in the radial hole when the stud screw is tightened. The door hinge described in this published European Patent Document does not permit a precise lateral adjustment of the door hinge when the door is installed in the door frame, because the required mechanical backlash of the stud screw in the groove of the attachment element inevitably leads to a dislocation of the attachment element in the radially extending hole when the stud screw has been released to radially or laterally adjust the door hinge. Additionally, there is the danger of the stud screw becoming deformed by shear forces caused by the weight of the door, particularly, when the hinge is used for heavy doors, which inevitably leads to a radial dislocation of the bolt-shaped attachment element when the stud screw is rotated to be tightened.

German Utility model G 89 06 780 discloses an axially and radially adjustable door hinge in which the radial adjustment is performed via a bolt-shaped attachment element which is rotatably inserted into a radially extending through-bore formed in an upper support element The bolt-shaped attachment element has a threaded portion which is screwed into a respective hole formed in the corresponding door, and a smooth head portion which has a larger diameter than that of the threaded portion. The through-bore accordingly has a first portion with a large diameter for receiving the head portion, and a second portion with a diameter which is smaller than the diameter of the head portion of the bolt-shaped attachment element, so that the bolt-shaped attachment element cannot slip out of the through-bore when it is rotated for radially adjusting the door with respect to the frame. For securing the attachment element in the through-bore, the upper support element is formed with an internally threaded axial hole in which a stud screw is rotatably arranged. By tightening the stud screw against the head of the bolt-shaped attachment element, the attachment element can be locked in the through-bore after the door has been radially adjusted. Because the head of the bolt-shaped attachment element is radially movable out of the though-bore of the upper support element when the stud screw is loosened, the door hinge is not fixedly held in position when the stud screw is loosened for radially adjusting the door. Thus, if the aforedescribed hinge used as a lower door hinge, it is not precisely adjustable, because the torque which is provided by the weight of the door always forces the bolt-shaped attachment element of the lower door hinge out of the through-bore. For an axial adjustment of the door, the aforedescribed door hinge further includes a bolt-element having a first smooth portion which is inserted into a respective axial pocket hole formed in the upper support element underneath the radial through-bore. The bolt-element further has a second threaded portion which is screwed into a corresponding internally threaded axial through-bore formed in the lower support element. A collar is formed between the smooth portion and the threaded portion for rotatably supporting the upper support element. For axially adjusting the door, the bolt-element is rotated in the internally threaded through-bore of the lower support element via a respective slot formed in the end surface of the threaded portion and with the aid of a screw driver which is inserted through the internally threaded through-bore from underneath. For securing the bolt-element against rotation after the axial position of the door has been adjusted, a stud screw is screwed into an internally threaded radial hole communicating with the axial through-bore of the lower support element. Because the stud screw is tightened against the threads of the bolt-element, the threaded portion of the bolt-element is easily damaged. In addition thereto, the torque which is necessary for rotating the bolt-element with the door upwardly against the weight of the door, can usually only be applied with a comparatively large screw driver. Due to the required small outer diameter of the support elements and the short distance between the support elements and the door or the door frame, the space provided for the screw driver is not sufficient to easily rotate the handle of the screw driver by hand. Thus, the aforedescribed hinge does not represent a practical solution and, moreover, the danger of damaging the door, the frame or the door hinge itself with the screw driver, when the axial position of a door is being adjusted, also exists.

SUMMARY OF THE INVENTION

It is accordingly an object of the invention of the instant application to provide an adjustable door hinge which can be produced economically, is of relatively simple construction and permits an easy, precise and secure radial and axial adjustment of a door, while the door is mounted in its corresponding door frame.

With the foregoing and other objects in view, there is provided, in accordance with one aspect of the invention, a door hinge for adjustably mounting a door in a corresponding door frame, comprising a first support element formed with an axially extending, internally threaded through-hole and having a first attachment device for fixedly connecting the first support element to the door frame, and a second support element formed with an axially extending hole and a radially extending through-hole and having a substantially bolt-shaped second attachment device rotatably received in said radially extending through-hole, said second attachment device having a threaded portion threadedly receivable in a respective internally threaded hole formed in the door, and being formed with an engagement device engageable by a tool for rotating the second attachment device, the second support element being formed with an internally threaded axial hole wherein a securing element for securing the second attachment device is rotatably disposed, a bolt element extending into the axially extending through-hole formed in said first support element and into said axially extending hole formed in the second support element for rotatably connecting the first and the second support elements, the bolt element having a first externally threaded end portion rotatably engaging in the internal thread of the axial through-hole formed in the first support element, a second end portion rotatably mounted in the second support element, and another portion located between the first and the second end portions and having a diameter at least equal to the diameter of the first and the second end portions, the other portion being formed with recesses wherein a tool is receivable for rotating the bolt element when the door is mounted in the corresponding door frame; and an externally threaded securing device received in the axial through-hole formed in the first support element for securing the bolt element therein against rotation relative to the first support element.

In accordance with another feature of the invention, the diameter of the other portion of the bolt element is substantially the same as the diameter of the second support element.

In accordance with a further feature of the invention, the securing device is a stud screw.

In accordance with an added feature of the invention, the stud screw is formed with an hexagonal socket.

In accordance with an additional feature of the invention, the first support element is mounted on the door and the second support element is mounted on the corresponding door frame.

In accordance with another aspect of the invention, there is provided a door hinge for adjustably mounting a door in a corresponding door frame, comprising a first support element having a first attachment device for fixedly connecting the first support element to the door frame, a second support element formed with a radially extending through-hole, a substantially bolt-shaped attachment element rotatably received in the radially extending through-hole attachment element and having a threaded portion received in a respective internally threaded hole formed in the door, and an engagement device engageable by a tool for rotating the second attachment element, the second support element being formed with an internally threaded hole wherein a securing element for securing the attachment element in the second support element is rotatably received; and a bolt element rotatably connecting the first and the second support elements, the radial through-hole formed in the second support element having a first portion with a diameter greater than that of a second portion thereof, and the second attachment element rotatably received in the second through-hole being formed with a smooth portion having a groove formed therein, the smooth portion of the second attachment element having a diameter greater than the diameter of the second portion of the radial through-hole, the securing element being formed with a peg-shaped projecting portion extending into the groove formed in the smooth portion of the second attachment element.

In accordance with yet another feature of the invention, the radial through-hole has a large diameter portion and a small diameter portion, the smooth portion of the second attachment element matching the large and small diameter portions.

In accordance with yet a further feature of the invention, the door hinge includes a substantially conical transition between the large diameter portion and the small diameter portion of the radial through-hole.

In accordance with yet an added feature of the invention, the door hinge includes a piece of resilient material disposed between the securing element and the attachment element.

In accordance with yet an additional feature of the invention, the other portion of the bolt element has an outer diameter which is substantially the same as the outer diameter of the first support element.

In accordance with a further aspect of the invention, there is provided a door hinge for adjustably mounting a door in a corresponding door frame, comprising a first support element formed with an axially extending, internally threaded through-hole and having a first attachment device for fixedly connecting the first support element to the door frame, and a second support element mountable on the door, the second support element being formed with an axially extending hole and carrying a substantially bolt-shaped attachment element having a threaded portion engageable in a respective internally threaded hole formed in the door, and a bolt element for rotatably connecting the first and the second support elements, the bolt element having an externally threaded first end portion rotatably engaging in the internal thread of the axially extending through hole formed in the first support element, and a second end portion rotatably mounted in the axially extending hole formed in the second support element, and another portion located between the first and second end portions and having a diameter at least equal to the respective diameter of the first and the second end portions, the other portion being formed with recesses for receiving therein a tool for rotating the bolt element when the door is mounted in the corresponding door frame; and a securing device rotatably disposed in the axially extending through-hole formed in the first support element for securing the bolt element therein against rotation relative to the first support element.

In accordance with another feature of the invention according to this further aspect, the diameter of the other portion of the bolt element is substantially the same as the diameter of the second support element.

In accordance with a further feature of the invention according to the further aspect, the securing device is a stud screw.

In accordance with an added feature of the invention according to the further aspect, the stud screw is formed with an hexagonal socket.

In accordance with a concomitant feature of the invention according to the further aspect, the first support element is mounted on the door and the second support element is mounted on the corresponding door frame.

An advantage of the invention of the instant application is that the time needed for adjusting a door is reduced to a fraction of the time needed for adjusting a conventional door hinge which is not axially and radially adjustable. Thereby, the door hinge according to the invention of the instant application does not require time-consuming and exhaustive removal and reinstallation of a door, which has often even been performed several times, so that, particularly in large buildings having a great number of doors, tremendous savings in manpower and in costs can be achieved. Additionally, use of the door hinges according to the invention of the instant application provides the further advantage that an axial and a radial adjustment of a door can be performed by persons having only minor technical skills, or by persons who do not have the physical strength required for lifting out and lifting in a heavy door alone. Furthermore, with the door hinges of the invention of the instant application, a highly precise radial and/or axial positioning of a door in the corresponding door frame can easily be performed, even if the tolerances of the respective parts of the door hinges are comparatively large due to being economical with respect to manufacturing costs. In other words, the door hinges according to the invention of the instant application can be produced at extremely low cost with high manufacturing tolerances of the used parts, without seriously reducing the precision of the radial and axial positioning.

Other features which are considered as characteristic for the invention are set forth in the appended claims.

Although the invention is illustrated and described herein as embodied in an adjustable door hinge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
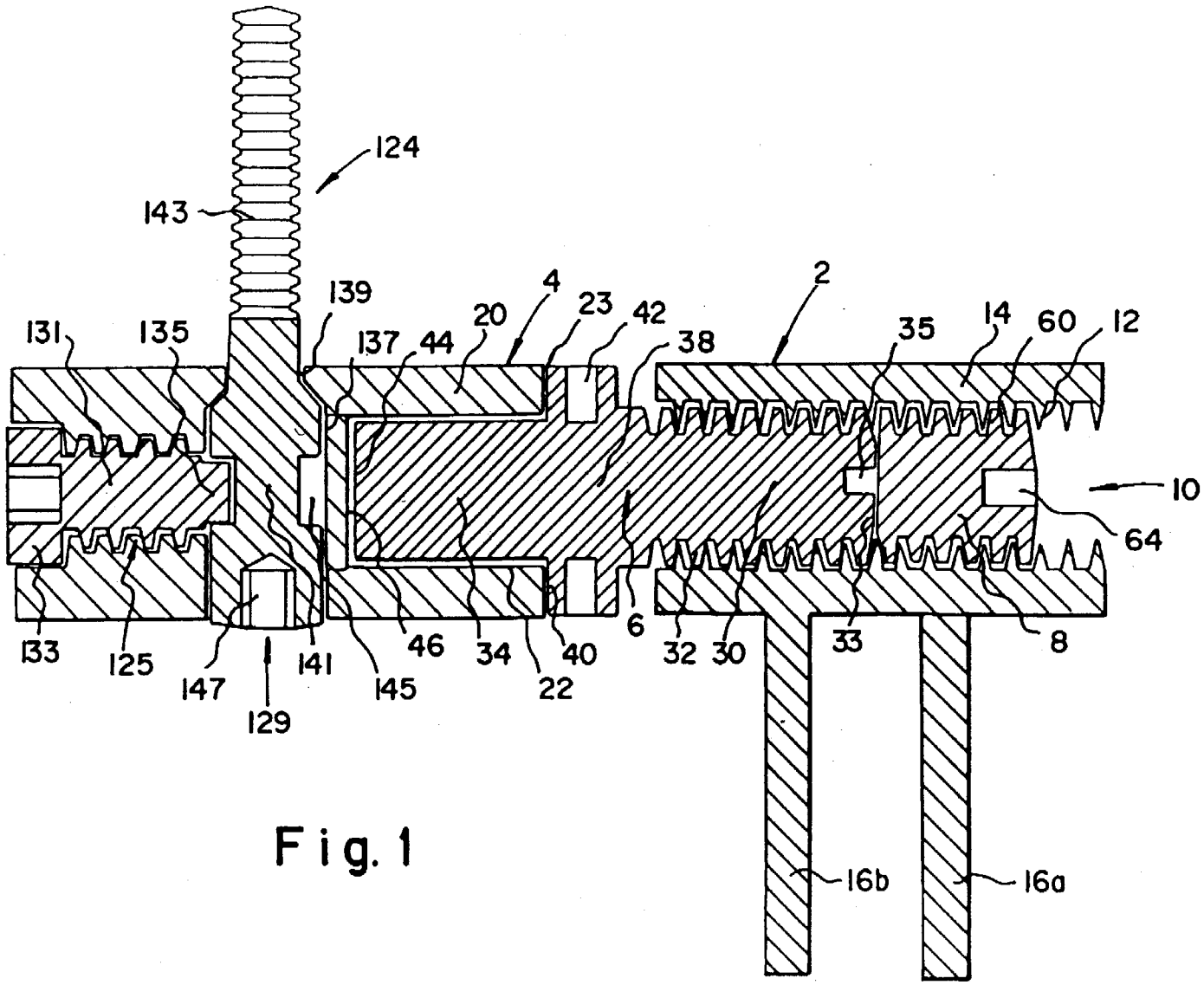
FIG. 1 is a diagrammatic sectional view of an axially and radially adjustable door hinge according to the invention of the instant application, in which the lower support element and the upper support element are arranged close to one another, i.e., when there is a relatively small spacing between the lower edge of the door and the floor.
Figure 2:
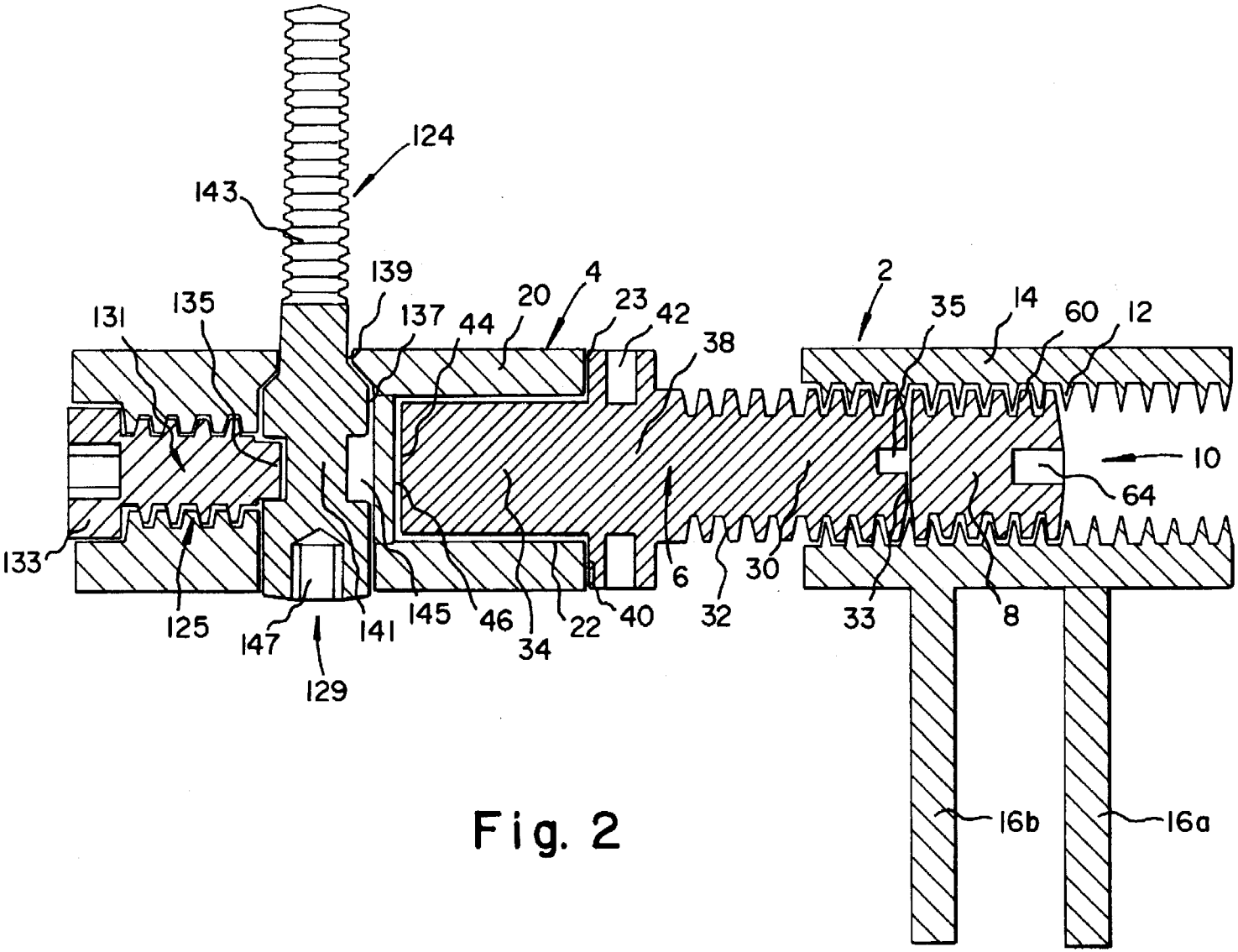
FIG. 2 is a diagrammatic sectional view of the door hinge of FIG. 1 in which the upper support element and the lower support element are arranged at a relatively greater distance from one another, i.e., when there is a relatively greater spacing between the lower edge of the door and the floor.

Referring now to FIGS. 1 and 2 of the drawings, there is shown therein an adjustable door hinge according to the invention which includes a first or lower support element 2, a second or upper support element 4 and a bolt-element 6 for connecting the first and second support elements 2 and 4.

The first support element 2 has a preferably cylindrical body 14, in which a through-bore or hole 10 with an internal thread 12 is formed. The body 14 has at least one, but preferably two pin-shaped radially extending attachment elements 16*a* and 16*b*, as shown in FIGS. 1 and 2, which are insertable into respective holes formed in a non-illustrated door frame and which provide for a fixed connection between the first support element 2 and the door frame.

The bolt-element 6 connecting the two support elements 2 and 4 has a first end portion 30 formed with an external thread 32, which is screwed into the internal thread 12 of the throughbore 10 of the first support element 2. The bolt-element 6 further has a second end portion 34 with a preferably smooth surface for rotatably supporting the second support element 4.

In the preferred embodiment of the invention, the bolt-element 6 has a third portion 38 which is arranged between the first end portion 30 and the second end portion 34. The outer diameter of the third portion 38 is different from that of the first end portion 30 and of the second end portion 34 In the preferred embodiment of the invention, the outer diameter of the third portion 38 corresponds to the outer diameter of the second support element 4 and/or to the outer diameter of the first support element 2. However, the diameter of the third portion 38 can also be larger or smaller.

A preferably ring-shaped end surface 40, which is directed towards the second end portion 34, is formed on the third portion 38. The end surface 40 together with an opposing ring-shaped end portion 23 at the upper support element 4 forms an axial bearing for receiving the axial forces caused by the weight of the door and transferred from the second support element 4 to the first support element 2. Preferably circular recesses 42, into which a tool, e.g. a screw driver, a nail, a spike or thorn or the end portion of an Allen key, or the like, can be inserted, are formed in the third portion 38 in order to rotate the bolt-element 6 in the lower support element 2, for adjusting the distance between the first and the second support elements 2 and 4 and thereby the axial position of the door. The recesses 42 are preferably arranged equidistantly around the circumference of the third portion 38, the number of the recesses 42 being preferably 3, 4 or greater, such as 8, for example. Instead of the recesses 42, circumferential surfaces may be provided which are arranged in parallel with one another on the third portion 38, in a manner similar to the head of a machine bolt, so that the bolt-element 6 can be rotated by means of a conventional wrench.

For adjusting the axial position of the door, the bolt-element 6 is further rotatable with the aid of a slotted, cross-slotted or hexagonal recess 35 formed in the end surface 33 of the first end portion 30 of the bolt-element 6 and a respective tool, e.g. a screw driver, an Allen key, or the like.

In order to prevent a further accidental rotation of the bolt-element 6 and thereby an undesired change in the axial position of the door after the door has been axially adjusted, a securing or safety device is provided in the form of a screw-element 8 formed with an external thread 60, which is screwed into the internal thread 12 of the axial through-bore 10 of the first support element 2 from a location thereof opposite to the location of the first end portion 30 or, in other words, from below. The screw-element 8 together with the first end portion 30 provides a threaded locknut-joint which securely prevents rotation of the bolt-element 6 in the axial through-bore 10 of the first support element 2. As a result, the bolt-element 6 is always secured very tightly and precisely in the through-bore 10, even if the backlash between the external threads 32 of the bolt-element 6 and the internal threads 12 of the lower support element 2 is comparatively great owing to reduced manufacturing costs. In the preferred embodiment of the invention, the screw-element 8 is a stud screw having a recess 64 in form of a slotted, a cross-slotted or preferably an hexagonal recess. In another embodiment of the invention, the screw-element 8 can also be a conventional machine screw, a slotted screw or a recessed head screw.

Furthermore, in an embodiment of the invention which is not shown in the drawings, the bolt-element 6 can be secured against rotation with respect to the first support element 2 by a non-illustrated securing or safety device in the form of a screw-element which is radially screwed into the body 14 of the first support element 2, by which the first end portion 30 of the bolt-element 6 is clamped within the though-bore 10 of the first support element 2. The location whereat the screw-element is screwed into the body 14 of the first support element 2 is in a region wherein the first end portion 30 is arranged within the first support element 2.

In the preferred embodiment of the invention shown in FIGS. 1 and 2, the upper support element 4 is formed of a cylindrical body 20, in which a first axial hole 22 for receiving the second end portion 34 of the bolt-element 6 is arranged. The upper support element 4 is formed further with a second axial internally threaded hole 125 for receiving the securing-element 131, and a third radial through-hole 129 arranged between the first and second axial holes 22 and 125 and communicating with the axial through-hole 125, for receiving a somewhat bolt-shaped attachment element 124.

The first axial hole 22 may be a pocket hole, for example, in which a bearing surface 46 is formed which, together with the opposing end surface 44 of the bolt-element 6, forms an axial bearing for receiving the weight of the door acting in the axial direction. In another embodiment of the invention, the hole 22 may be formed so as to communicate with the radial through-hole 129 so that the door is axially rotatably supported solely on a ring-shaped end surface 23 formed on the body 20 of the upper support element 4 and the corresponding ring-shaped end surface 40 formed on the third portion 38 of the bolt-element 6. The axially rotatable support of the second support element 4 and the bolt-element 6 can therefore either be provided selectively solely by the end surfaces 23 and 40, solely by the end surfaces 44 and 46 or by the end surfaces 23 and 40 as well as by the end surfaces 44 and 46.

The securing-element 131 which, as shown, for example, in FIGS. 1 and 2, may be a pan head or a fillister head screw (according to German Industrial Standard DIN 912) with a hexagonal socket 133, e.g., a socket head cap screw or a gudgeon or locking screw (DIN 915), is screwed into the internal thread formed in the second axial hole 125. In the preferred embodiment of the invention, the securing-element 131 has a peg-shaped projecting portion 135 which extends down into the radial through-hole 129 when the securing-element 131 is nearly entirely screwed into the second axial hole 125.

The radial through-hole 129 has a first portion 137 of relatively large diameter and a second portion 139 of relatively small diameter. In the preferred embodiment of the invention, the transition between the first portion 137 and the second portion 139 is cone-shaped. The bolt-shaped attachment element 124 which is inserted into the through-hole 129 has a smooth first portion 141 which matches or is adapted to the first and second portions 137 and 139 of the second though-hole 129. The bolt-shaped attachment element 124 further has a threaded second portion 143 which is screwed into a corresponding non-illustrated internally threaded hole formed in the door or in the door frame. In the preferred embodiment of the invention, a groove 145 is formed approximately in the middle of the smooth portion 141 of the attachment element 124. The peg-shaped projecting portion 135 of the securing element 131 extends downwardly into the groove 145, so that the projecting portion 135 engages in the groove 145 of the attachment element 124. The groove 145 is preferably of such depth that the attachment element 124 is locked in the through-hole 129 by the projecting portion 135 engaging in the groove 145 when the securing element 131 is nearly entirely screwed into the second internally threaded axial hole 125, so that the attachment element 124 is fixed against axial and radial movement in the through-hole 129. In a further embodiment of the invention, a non-illustrated thin piece of resilient material, such as rubber or polyurethane or other type of plastic material, for example, is arranged between the peg-shaped projecting portion 135 and the internal circumferential surface of the groove 145, which prevents the securing element 131 from loosening, even if it is not properly tightened in the second axial through-hole 125. Moreover, the resilient material even permits a tightening of the securing element 131 by hand without using a tool, when the head of the securing element 131 is extended out of the second axial through-hole 125. The resilient material can either be loosely inserted into the axial hole 125 or can be glued or otherwise adhesively secured to the end surface of the securing element 131. The resilient material is of such thickness that the peg-shaped projecting portion 135 remains at least partially extended into the groove 145. The resilient material may have a thickness, for example, in a range between 0.1 to 3 mm. Similarly, a non-illustrated washer or ring of resilient material such as of rubber or plastics, for example, may be provided between the head 133 of the securing element 131 and the respective adjoining end surface of the second axial through-hole 125.

For radially adjusting a door which is mounted on a corresponding door frame by door hinges according to the embodiment of the invention shown in FIGS. 1 and 2, the securing element 131 is loosened or released slightly so that the attachment element 124 is freely rotatable in the through-hole 129, but the peg-shaped projecting portion 135 remains engaged in the groove 145 The attachment element 124 is then rotated in the through-hole 129 until the desired radial spacing or distance between the upper support element 4 and the door or the door frame has been adjusted. The rotation of the attachment element 124 can be performed with the aid of a recess or an hexagonal socket 147 formed at the end surface of the attachment element 124, and a respective screw driver or Allen key. After the desired radial distance has been adjusted, the securing element 131 is tightened again, until the attachment element 124 is fixedly clamped in the through-hole 129. When the herein afore-described piece of resilient material is used, it is sufficient even to tighten the securing-element 131 just with the fingers, without using a further tool, provided that the head 133 of the securing element 131 extends sufficiently far out of the second axial hole 125.

In the preferred embodiment of the invention, the securing element 131 and the attachment element 124 of the upper support element 4, as well as the screw element 8 of the lower support element 2 are uniformly formed by equal hexagonal sockets or recesses, so that they all can be adjusted with the same Allen key or screw driver. Moreover, the recesses 42 provided in the bolt element 6, are preferably formed as bores having a diameter of about the same size as the other hexagonal sockets, so that the whole door hinge can be axially and radially adjusted with only one tool, preferably an Allen key.

The adjustable door hinge according to the invention of the instant application is advantageously used in the form of a combination of an axially adjustable lower support element 2 and a radially adjustable upper support element 4 shown in FIGS. 1 and 2. Moreover, it is also possible that the lower support element 2 according to the invention of the instant application can be combined with a conventional, non-adjustable upper support element. Furthermore, it is also possible to combine the upper support element 4 of the invention of the instant application with an axially non-adjustable conventional lower support element.

The upper and lower support element 2, 4 is preferably of such size that the outer diameter thereof, the diameter of the attachment device 16*a*, 16*b* and the attachment element 124 and the axial length of the upper support element 4 are equal to the size of a conventional non-adjustable door hinge. The axial length of the lower support element 2 and the position of the attachment device 16*a*, 16*b* formed on the body 14 of the first support element 2 are preferably selected so that the zero-position of the door with respect to the corresponding door frame or the zero-position of the door with respect to the floor is equal to or coincides with the position of a door equipped with conventional door hinges in its basic adjustment, when about one half to one quarter of the respective threads 32 of the first end portion 30 of the bolt element 6 is screwed into the internally threaded axial through-hole 10 of the first support element 2.

Furthermore, the possibility exists that the first support element 2 may be mounted at the door and the second support element 4 may be mounted at the corresponding door frame, or in other words, that the first support element 2 be replaced by the second support element 4 and vice versa.

The support elements 2 and 4 and the bolt element 6 are preferably formed of metal, such as iron, steel, brass, aluminum, and the like, for example. However, it is also possible that the aforedescribed support elements 2 and 4 or the bolt element 6 are partially or entirely formed of another material, such as plastic material, for example.

I claim:

1. Door hinge for adjustably mounting a door in a corresponding door frame, comprising a first support element formed with an axially extending, internally threaded through-hole and having a first attachment device for fixedly connecting said first support element to the door frame, and a second support element formed with an axially extending hole and a radially extending through-hole and having a substantially bolt-shaped second attachment device rotatably received in said radially extending through-hole, said second attachment device having a threaded portion threadedly receivable in a respective internally threaded hole formed in the door, and being formed with an engagement device engageable by a tool for rotating said second attachment device, said second support element being formed with an internally threaded axial hole wherein a securing element for securing said second attachment device is rotatably disposed, a bolt element extending into said axially extending through-hole formed in said first support element and into said axially extending hole formed in said second support element for rotatably connecting said first and said second support elements, said bolt element having a first externally threaded end portion rotatably engaging in said internal thread of said axial through-hole formed in said first support element, a second end portion rotatably mounted in said second support element, and a third portion located between said first and said second end portions and having a diameter at least equal to the diameter of said first and said second end portions, said third portion being formed with recesses wherein a tool is receivable for rotating said bolt element when the door is mounted in the corresponding door frame; and an externally threaded securing device received in said axial through-hole formed in said first support element for securing said bolt element therein against rotation relative to said first support element.

2. Door hinge according to claim 1, wherein said diameter of said third portion of said bolt element is substantially the same as the diameter of said second support element.

3. Door hinge according to claim 1, wherein said securing device is a stud screw.

4. Door hinge according to claim 3, wherein said stud screw is formed with an hexagonal socket.

5. Door hinge according to claim 1, wherein said first support element is mounted on the door and said second support element is mounted on the corresponding door frame.

6. Door hinge according to claim 1, wherein said other portion of said bolt element has an outer diameter which is substantially the same as the outer diameter of said first support element.

7. Door hinge for adjustably mounting a door in a corresponding door frame, comprising a first support element having a first attachment device for fixedly connecting said first support element to the door frame, a second support element formed with a radially extending through-hole, a substantially bolt-shaped attachment element rotatably received in said radially extending through-hole attachment element and having a threaded portion received in a respective internally threaded hole formed in the door, and an engagement device engageable by a tool for rotating said second attachment element, said second support element being formed with an internally threaded hole wherein a securing element for securing said attachment element in said second support element is rotatably received; and a bolt element rotatably connecting said first and said second support elements, said radial through-hole formed in said second support element having a first portion with a diameter greater than that of a second portion thereof, and said second attachment element rotatably received in said radially extending through-hole being formed with a smooth portion having a groove formed therein, said smooth portion of said second attachment element having a diameter greater than the diameter of said second portion of said radial through-hole, said securing element being formed with a peg-shaped projecting portion extending into said groove formed in said smooth portion of said second attachment element.

8. Door hinge according to claim 7, wherein said radial through-hole of said second support element has a large diameter portion and a small diameter portion, said smooth portion of said second attachment element having a surface that matches said large and small diameter portions.

9. Door hinge according to claim 8, including a substantially conical transition between said large diameter portion and said small diameter portion of said radial through-hole.

10. Door hinge according to claim 8, including a piece of resilient material disposed between said securing element and said second attachment device.

11. Door hinge for adjustably mounting a door in a corresponding door frame, comprising a first support element formed with an axially extending, internally threaded through-hole and having a first attachment device for fixedly connecting said first support element to the door frame, and a second support element mountable on the door, said second support element being formed with an axially extending hole, and said second support element carrying a substantially bolt-shaped attachment element having a threaded portion engageable in a respective internally threaded hole formed in the door, and a bolt element for rotatably connecting said first and said second support elements, said bolt element having an externally threaded first end portion rotatably engaging in the internal thread of said axially extending through hole formed in said first support element, and a second end portion rotatably mounted in said axially extending hole formed in said second support element, and a third portion located between said first and second end portions and having a diameter at least equal to the respective diameter of said first and second end portions, said third portion being formed with recesses for receiving therein a tool for rotating said bolt element when the door is mounted in the corresponding door frame; and a securing device rotatably disposed in said axially extending through-hole formed in said first support element for securing said bolt element therein against rotation relative to said first support element.

12. Door hinge according to claim 11, wherein said diameter of said third portion of said bolt element is substantially the same as the diameter of said second support element.

13. Door hinge according to claim 11, wherein said securing device is a stud screw.

14. Door hinge according to claim 13, wherein said stud screw is formed with an hexagonal socket.

15. Door hinge according to claim 11, wherein said first support element is mounted on the door and said second support element is mounted on the corresponding door frame.

* * * * *